US009138023B2

(12) United States Patent
Karam

(10) Patent No.: US 9,138,023 B2
(45) Date of Patent: Sep. 22, 2015

(54) HEADBAND WITH INTEGRAL COMPARTMENT AND HAIR ACCESSORY

(71) Applicant: Karen Karam, Pompano Beach, FL (US)

(72) Inventor: Karen Karam, Pompano Beach, FL (US)

( * ) Notice: Subject to any disclaimer, the term of this patent is extended or adjusted under 35 U.S.C. 154(b) by 0 days.

(21) Appl. No.: 14/077,921

(22) Filed: Nov. 12, 2013

(65) Prior Publication Data

US 2014/0130819 A1 May 15, 2014

Related U.S. Application Data

(60) Provisional application No. 61/724,348, filed on Nov. 9, 2012.

(51) Int. Cl.
*A41G 5/00* (2006.01)
*A41D 20/00* (2006.01)

(52) U.S. Cl.
CPC ..... *A41G 5/0093* (2013.01); *A41D 20/00* (2013.01)

(58) Field of Classification Search
CPC ..... A41D 20/00; A41G 5/0093; A45D 8/00; A45D 8/36
USPC ..... 132/273, 275, 53; 2/171, 174, 171.2, 2/DIG. 11; D28/41, 92
See application file for complete search history.

(56) References Cited

U.S. PATENT DOCUMENTS

| | | | | |
|---|---|---|---|---|
| 4,723,325 | A | 2/1988 | Perry | |
| 4,998,544 | A | 3/1991 | Obergfell | |
| 5,105,475 | A | 4/1992 | Lynd et al. | |
| 5,174,312 | A | 12/1992 | Adams | |
| 5,186,186 | A | 2/1993 | Hamilton | |
| 5,239,705 | A | 8/1993 | Leopold | |
| D344,176 | S | 2/1994 | Lawrence | |
| 5,293,884 | A | 3/1994 | Chapman et al. | |
| 5,321,854 | A | 6/1994 | Kronenberger | |
| 5,472,003 | A | 12/1995 | Frame et al. | |
| 5,511,249 | A | 4/1996 | Higgins | |
| 5,546,603 | A | 8/1996 | Lawhorne et al. | |
| 5,590,422 | A | 1/1997 | Henderson | |
| 6,766,805 | B1 * | 7/2004 | Cupp | 132/53 |
| 2009/0183751 | A1 * | 7/2009 | Tu | 132/273 |
| 2010/0095977 | A1 | 4/2010 | Schmitz et al. | |

* cited by examiner

*Primary Examiner* — Rachel Steitz
(74) *Attorney, Agent, or Firm* — VanOphem IP Law PLC

(57) ABSTRACT

A headband assembly includes a lower band element and an upper band element. The lower band element has upstanding flanges that define a cavity to provide for storage of personal items such as eyeglasses, lipstick, lip balm, etc., and the flanges include a plurality of reliefs or notches therein for making the lower band flexible. The upper band element pivots with respect to the lower element and includes a lock mechanism. The lower band element also includes a plurality of coupling members in the form of rows of rod-shaped bar members for receiving and coupling with a clip. The clip member may be coupled to a hair accessory which may include any known or appropriate accessory. The coupling members are integrated in the lower band on the front and back sides of the upstanding flanges as well as on the bottom surface of the lower band to provide greater flexibility and accessorizing options. The ornamental designs of the headband, eyeglass frame, and clips are also disclosed.

7 Claims, 13 Drawing Sheets

HEADBAND WITH INTEGRAL COMPARTMENT AND HAIR ACCESSORY

CROSS-REFERENCE TO RELATED APPLICATIONS

This application claims priority to U.S. Provisional Patent Application No. 61/724,348, filed Nov. 9, 2012, entitled Headband With Integral Compartment And Hair Accessory, to Karen Karam, the entire contents of which are incorporated herein for all purposes.

The present disclosure relates in general to a decorative device adapted to be worn by a person. More particularly, the present disclosure relates to a decorative device incorporating, in a combined structure, a temporary storage compartment for items, such as eyewear, and a retainer for retaining artificial or natural hair secured to the headgear.

BACKGROUND

Generally, it is known to combine a headband or hair band with a hair gathering device are known. For example, U.S. Pat. No. 5,590,422, to Donna J. Henderson, discloses a combined headband and hair retainer comprised of an elastic headband and a malleable tie device secured thereto, wherein the malleable tie device would be wrapped and/or twisted around gathered hair with the malleable tie device having sufficient rigidity to form a ponytail holder. The Henderson patent discloses an arrangement wherein a separate device is furnished for securing the ponytail, wherein the device holds the ponytail as a result of malleable deformation.

Further, U.S. Design Pat. No. 344,176, to Gary D. Lawrence, discloses an ornamental design for a headband wherein the headband is terminated at the rear of the head with a pouch and wherein the pouch would be used for receiving and covering a ponytail. The Lawrence patent discloses a fabric pouch forming the rear portion of a headband, wherein the pouch can be used for storing, or for containing a gathered ponytail.

U.S. Pat. No. 4,723,325 to Perry discloses a combination sweatband and facial towel and which are twisted into two loops. U.S. Pat. No. 5,186,186, to Hamilton discloses a multipurpose ornament and method for use in retaining hair. The body ornament includes an elastic retainer member which releasably engages the body ornament to the mass of the hair. U.S. Pat. No. 5,293,884 to Chapman et al. discloses a loop strap hair tie of a certain shape. U.S. Pat. No. 5,472,003 to Frame et al. discloses a hair accessory for a ponytail. A bottom loop 16 grips the hair to position the bottom loop 16 and set the effective length of the sleeve 12 relative to the ponytail. U.S. Pat. No. 5,511,249 to Higgins discloses a cap with a crown opening. U.S. Pat. No. 5,546,603 to Takashima discloses a generally straight shape or a widely curved shape. A portion of the wearer's hair is held in contact with the hair-retaining member, and the first and second ends of the hair-retainer member are wrapped or twisted around the hair portion, thereby retaining the hair portion in a ponytail form. The closed-loop is preferably a closed-loop band of a resilient fabric. Preferably the fabric is both elastic and absorbent, or the closed-loop is provided with an absorbent liner for absorbing perspiration. Headgear articles have been devised which include a hair retaining feature. U.S. Pat. No. 4,998,544, for example, discloses a headband having an aperture therein through which long hair may be passed for retaining the hair in what is commonly termed a "ponytail." U.S. Pat. No. 5,321,854 discloses a baseball-style cap having a hole in a wall thereof through which hair may be passed to form a ponytail. U.S. Pat. No. 5,239,705 also discloses a cap having a hole therein through which hair may be passed to form a ponytail. U.S. Pat. No. 5,174,312 discloses a headband having hingedly coupled combs attached thereto. Long hair is retained by closing the combs thereon, the combs are held in a closed position by a retaining device.

U.S. Patent Publication No. 2010/0095977 to Schmitz et al. discloses a headband assembly that includes lower and upper band elements which define a cavity there between. Eyeglasses are pivotally connected to the headband assembly via a connection that allows the eyeglasses to pivot between two positions; an extended position on the user's face, and a pivotally retracted position within the cavity of the hair band. In Lynd et al., U.S. Pat. No. 5,105,475, a headgear is provided having a head element adapted to be worn by a person and includes in combination an eye shield carried by the head element and which may be selectively positioned relative to the head element in either a shielding or covering position relative to the wearer's eyes or in a stored position. The head element has a section that is positionable on a wearer's forehead in secured relationship by a headband and is formed with a forwardly projecting visor and a storage compartment to contain the eye shield. The eye shield is of a configuration to extend across the wearer's eyes terminating in rearward extending support arms that pivotally interconnect with the head element such that the eye shield may be pivoted between a stored position in the compartment and an operative position in front of the wearer's eyes.

It is believed that the above-described devices have certain shortcomings. Any device which relies on catches or closure devices for retaining hair invites the possibility of catching or tangling hair in the catch or closure. Pulling hair through an aperture or extricating tangled hair from a catch or closure may be damaging to the hair and painful to the wearer. Further, few of these devices offer the storage feature in addition to the fashionable hair accessory integrated with the headgear. None of the above prior art devices of the noted patents include eyewear, such as sunglasses, that can be stored within the headgear worn on top of the head when the eyewear is not in use by the wearer and wherein the headgear further provides an attachment for attaching any of a plurality of devices included but not limited to an artificial or natural hair piece secured to the headgear.

SUMMARY

In one exemplary embodiment of the present disclosure there is provided a headband that defines a closed storage cavity between a lower portion and a pivotally connected upper portion. The headband or headgear assembly includes a lower band portion that is shaped as an open loop that conforms to the wearer's head when positioned on the wearer's head. The headband assembly also includes an upper portion that is connected to the lower portion, wherein the upper portion is shaped as an open loop that conforms to a wearer's head when positioned on the wearer's head. The upper portion and lower portion define a closed cavity there between when the upper portion is pivoted to a position above the lower portion when both the upper portion and lower portion are positioned on the wearer's head. The closed cavity is capable of storing any one of a number of personal items used by the wearer, i.e., sunglasses, lip balm, lip stick, etc.

The headband of the present disclosure may also provide the wearer with a hair accessory attachment or coupling feature for connecting any number of attachments and accessories to the headband in numerous positions and combinations. In one exemplary embodiment, the hair accessory may include, but not be limited to, hair extensions, hair wefts, hair wigs, hair falls, hair mini wigs, hair ponytails, hair braids, hair bangs, hair tendrils, hair buns, hair pieces, hair domes, hair bumps, hair curls, hair bands, hair nets, hair combs, beads, feathers, ribbons, bows, lace, crowns, visors, party hats, standard hats, beanies, game day head accessories, holiday and celebration themed accessories (e.g., Christmas, New Year's Eve, etc.). The headband and its components may further be adorned with any kind of beads, semi and precious stones, crystals, animal figures, cartoon character figures, animal ears, scarfs, and etc.

The surface of the lower band portion facing the wearer's head is provided with a fastening element to which can be temporarily attached a hair accessory, i.e. hair extension, hair braids, hair netting, or hair adornment in the form of jewelry, etc. The hair accessory may be used to highlight or decorate the hair to maintain the hair in position such as a hairnet.

Therefore, it is an object of the present invention to provide headgear which includes a storage compartment for eyeglasses or sunglasses which are not being worn by the user. It is another object of the present invention to provide headgear that provides for storing eyeglasses or sunglasses which are not in use and that is economical to manufacture.

It is yet a further object of the present invention to provide a headgear which includes a storage compartment for eyeglasses or sunglasses which are not being used by the wearer and also further provides an attachment feature for an artificial or natural hair accessory which may be temporarily or permanently, conveniently attached to the headband and adapted to be sandwiched between layers of natural or artificial hair on the user's head. By non-limiting example, such hair feature may be a hair extension, hair braids, hair highlighter, and/or hair netting.

It is yet a further object of the present invention to provide headgear with a storage feature for eyeglasses and an attachment feature for hair accessories which is easy to use, simple to assemble and economical to manufacture. Another object of the invention is to provide a means whereby hair of contrasting shades may be used wherefore the effect of "streaking" in the hair is secured, if desired, without the need to bleach or color the natural hair. These and other objects will become apparent hereinafter in the following detailed description of the preferred embodiment which follows, taken with the accompanying drawings.

DETAILED DESCRIPTION

Figure 1:
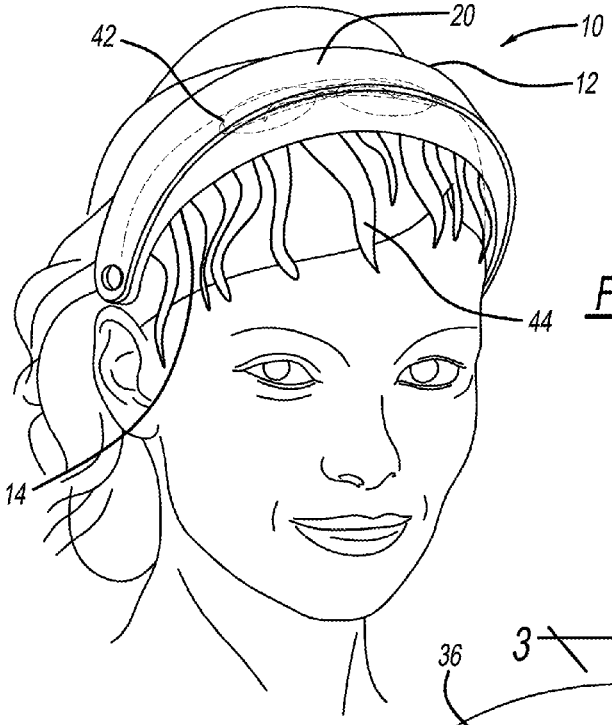
FIG. 1 is a perspective view of a headband according to an exemplary embodiment of the present disclosure.
Figure 2:
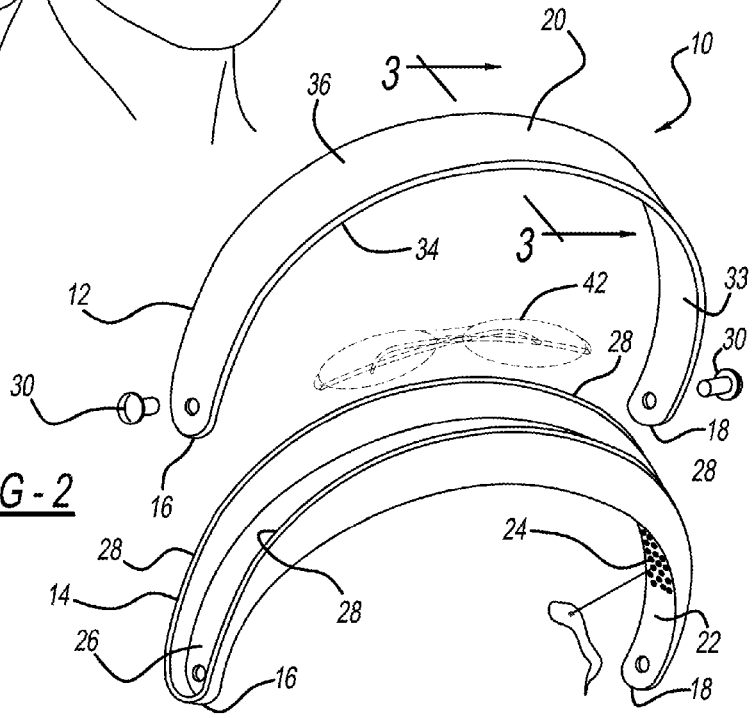
FIG. 2 is a perspective exploded view of the headband of FIG. 1 highlighting the storage compartment between the upper and lower portions.
Figure 3:
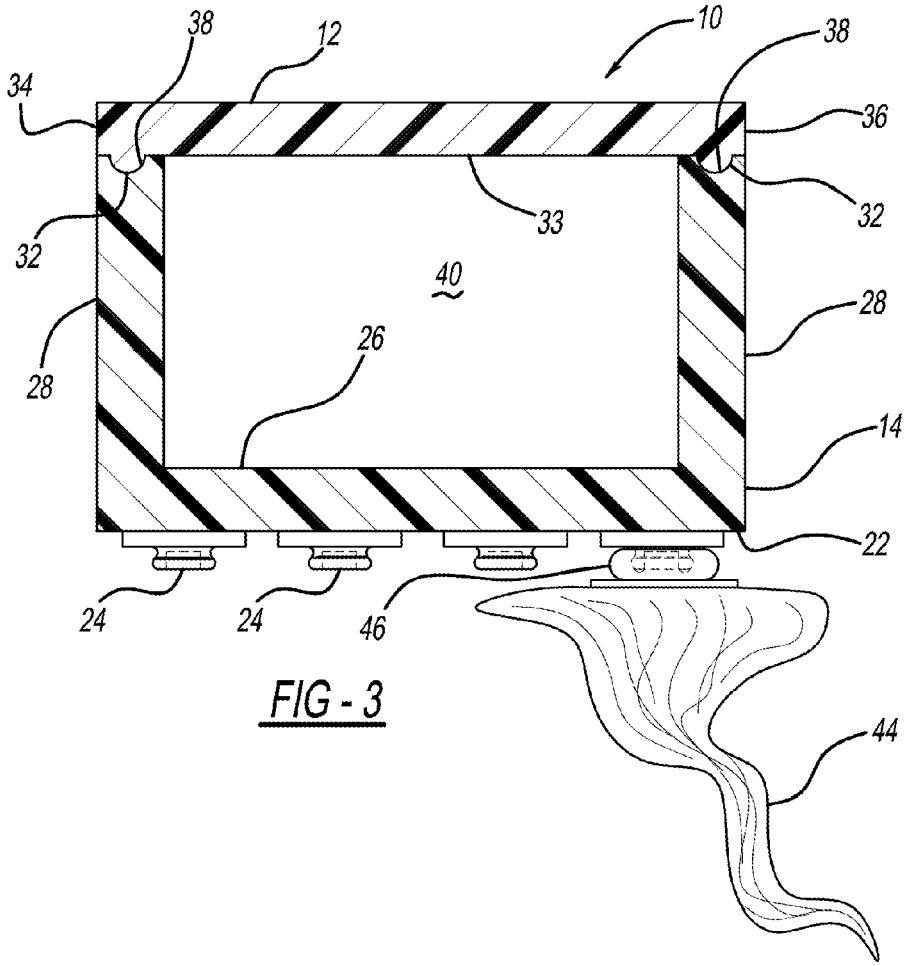
FIG. 3 is a cross-section taken along line 3-3 of FIG. 2 with the headband assembled (without eyeglasses) and the hair accessory attachment feature as shown in the illustrative of FIG. 1.

There is illustrated in FIGS. 1 through 3 an improved headband or hair gear formed in accordance with a preferred embodiment of the present invention and generally designated by reference character 10. The headband 10 is conventional in that it is a continuous band fabricated from plastic or any other convenient material having an upper band element 12 and a lower band element 14. As illustrated in FIG. 1, the upper and lower band elements 12, 14 are shaped as respective open loops that conform to the shape of the head of a wearer when positioned over the top of the wearer's head. In one embodiment, the headband 10 defines an opening that fits over the top of the wearer's head, and the hair band 10 extends from a first end portion 16 proximate the wearer's ear, across the top of the head, and continuous over the head to a second end portion 18 proximate the other ear on the opposite side of the head.

FIG. 1 illustrates one of the embodiments of the invention being worn. When worn, the headband 10 is positioned substantially vertically on the wearer's head so that a top portion 20 of the upper band element 12 is positioned substantially above the top of the wearer's head. The lower band element 14 includes a lower inside surface 22 that includes provisions for a fastening element which will be described hereinafter in detail. The fastening element or clip may help secure the hair band 10 on the wearer's head.

In one exemplar embodiment of the present disclosure, the headband 10 provide a combination eye wear storage and hair accessory. The eye wear may be stored entirely enclosed within the hair band. For this purpose, the lower band element 14 is provided with a lower surface 26 which is peripherally defined by an upstanding flange 28 which may be of varying heights to accommodate eye wear frames of different configurations. Since the lower band element 14 as well as the upper band element 12 is fabricated from plastic, different size molds can simply be used to obtain lower band elements 14 that have varying upstanding flanges 28 with different heights.

Figure 7:
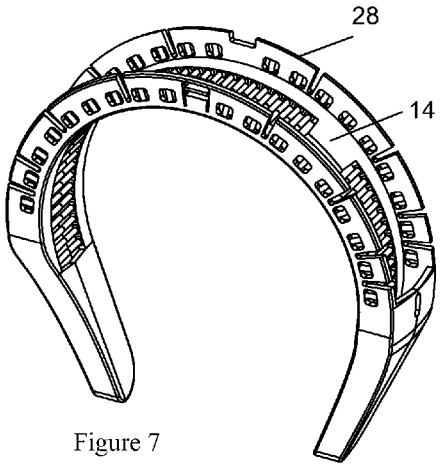
FIG. 7 is a graphic perspective view of the lower portion of the headband of FIG. 4 according to an alternate exemplary embodiment of the present disclosure.
Figure 8:
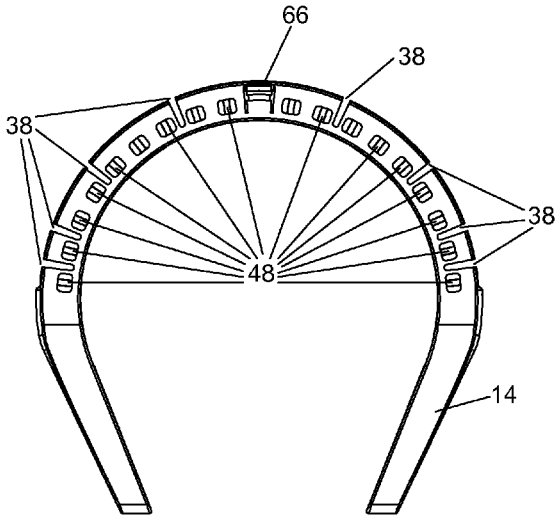
FIG. 8 is a front graphic view of the lower portion of the headband of FIG. 7.
Figure 10:
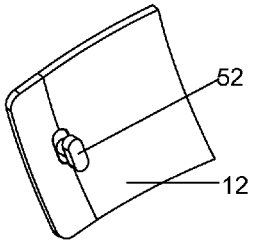
FIG. 10 is a perspective graphic view of the upper portion of the headband of FIG. 4.
Figure 11:
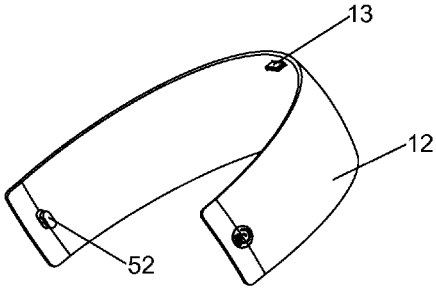
FIG. 11 is a partial perspective graphic view of the upper portion of FIG. 10.
Figure 12:
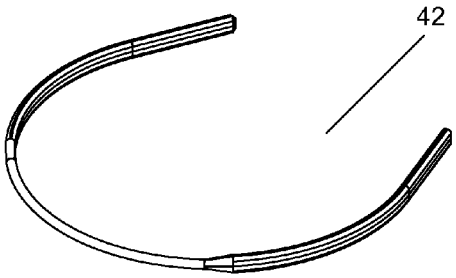
FIG. 12 is a perspective graphic view of an eyeglass frame having a design according to an exemplary embodiment of the present disclosure having particular utility with the headband of the present disclosure.
Figure 13:
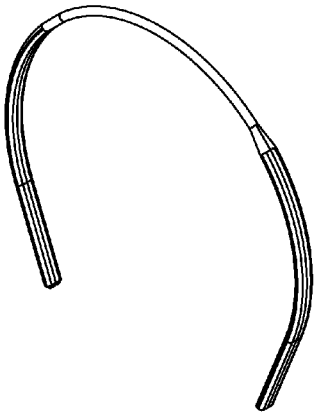
FIG. 13 is an alternate perspective graphic view of the eyeglass frame of FIG. 12.
Figure 13A:
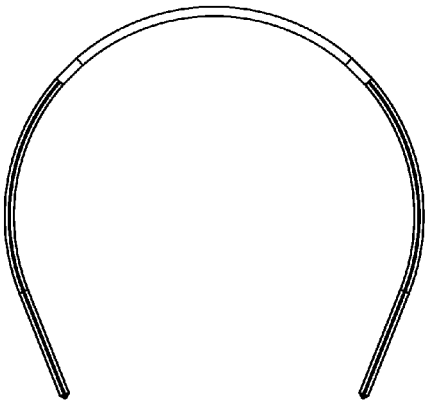
FIG. 13A is a front graphic view of the eyeglass frame of FIG. 12.
Figure 13D:
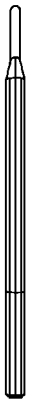
FIG. 13D is a side graphic view of the eyeglass frame of FIG. 12.
Figure 13B:
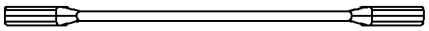
FIG. 13B is a top graphic view of the eyeglass frame of FIG. 12.
Figure 13C:
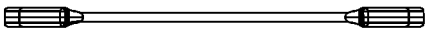
FIG. 13C is a bottom graphic view of the eyeglass frame of FIG. 12.
Figure 14:
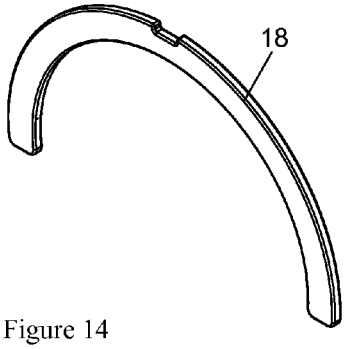
FIG. 14 is a perspective graphic view of a front cover of the headband of FIG. 4.
Figure 15:
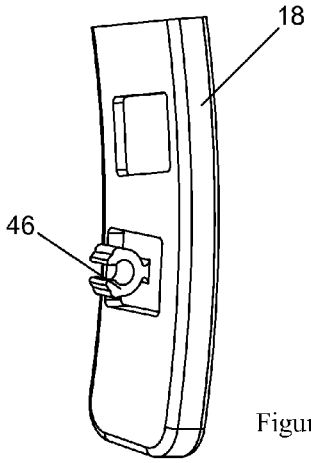
FIG. 15 is a partial perspective graphic view of an end of the front cover of FIG. 16.
Figure 16:
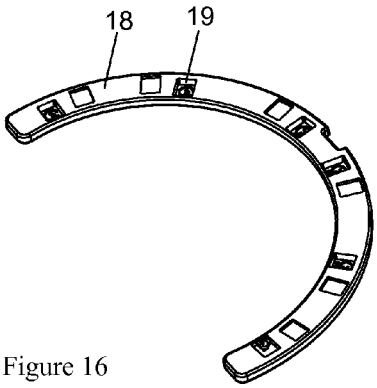
FIG. 16 is an alternate partial perspective graphic view of the front cover of FIG. 14.
Figure 17:
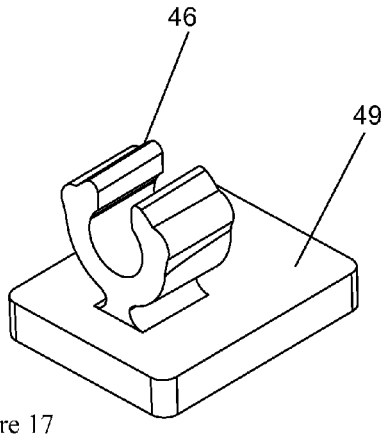
FIG. 17 is a graphic perspective view of a clip according to an exemplary embodiment of the present disclosure.
Figure 18:
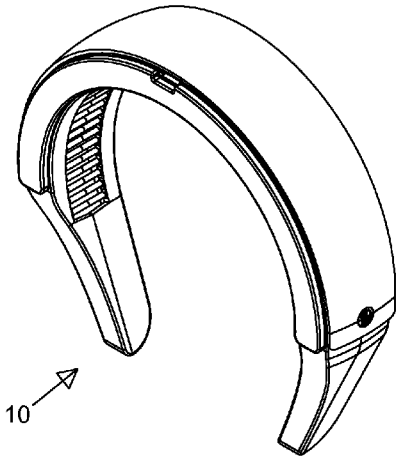
FIG. 18 is a graphic perspective view of a design of a headband according to an exemplary embodiment of the present disclosure.
Figure 19:
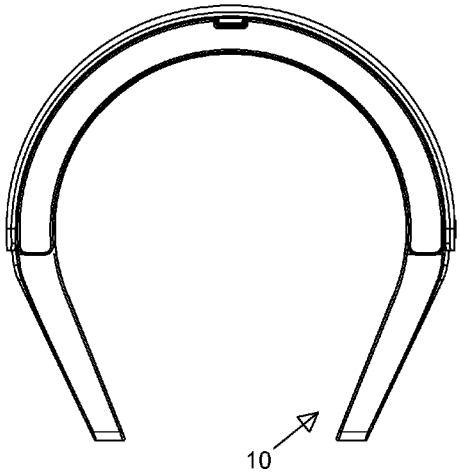
FIG. 19 is a front graphic view of the headband of FIG. 18.
Figure 20:
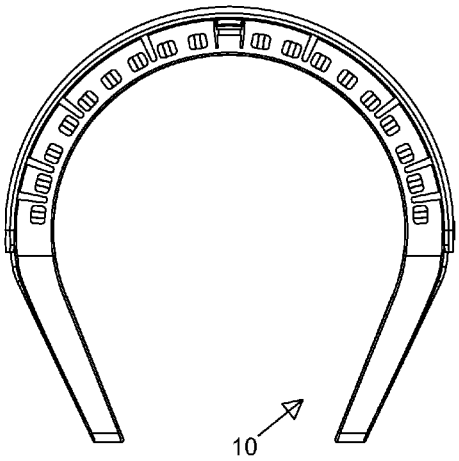
FIG. 20 is a back graphic view of the headband of FIG. 18.
Figure 21:
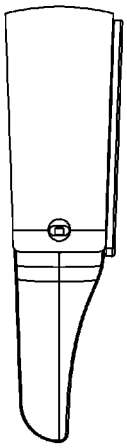
FIG. 21 is a right side graphic view of the headband of FIG. 18.
Figure 22:
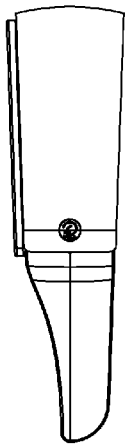
FIG. 22 is a left side graphic view of the headband of FIG. 18.
Figure 23:
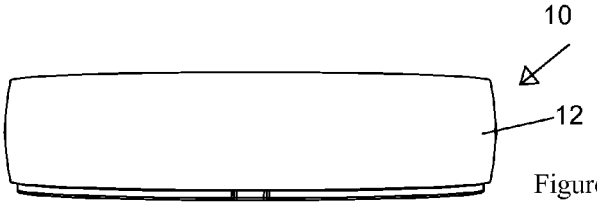
FIG. 23 is a top graphic view of the headband of FIG. 18.
Figure 24:
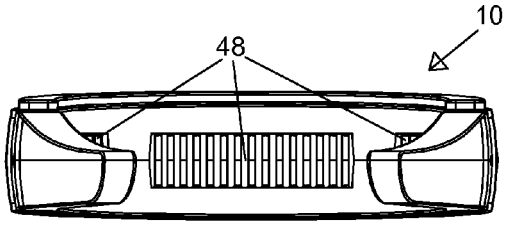
FIG. 24 is a bottom graphic view of the headband of FIG. 18.
Figure 26:
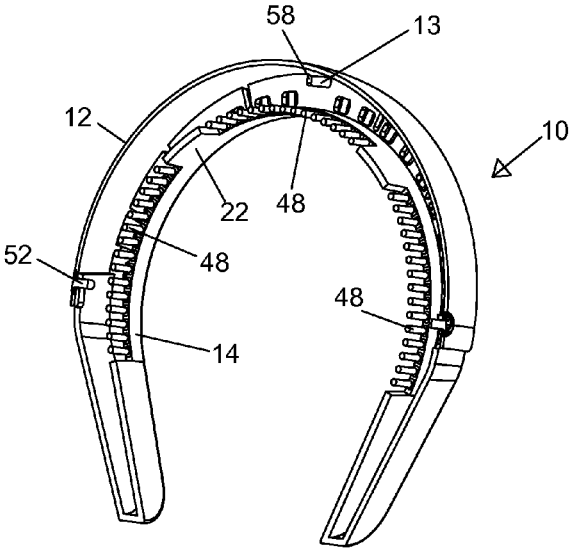
FIG. 26 is an alternate partial section perspective view of the headband of FIG. 18.
Figure 27:
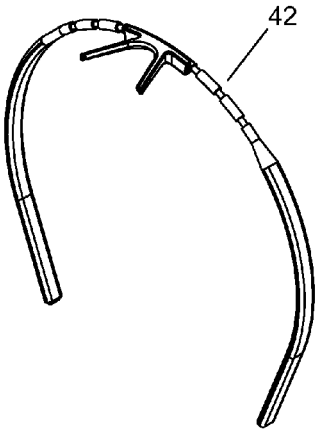
FIG. 27 is a perspective graphic view of an eyeglass frame having a design according to an exemplary embodiment of the present disclosure having particular utility with the headband of the present disclosure.
Figure 28:
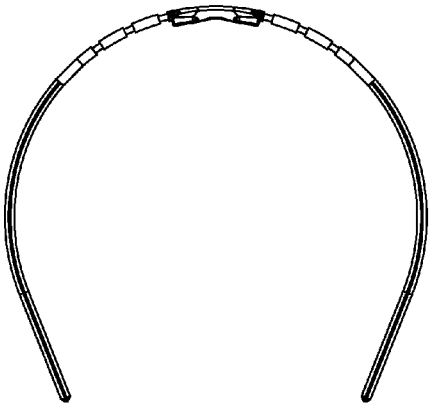
FIG. 28 is a top graphic view of the eyeglass frame of FIG. 27.
Figure 29:
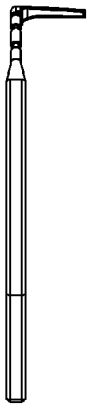
FIG. 29 is a right side graphic view of the eyeglass frame of FIG. 27.
Figure 30:
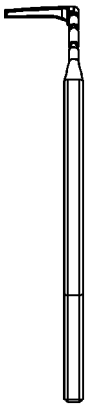
FIG. 30 is a left side graphic view of the eyeglass frame of FIG. 27.
Figure 31:
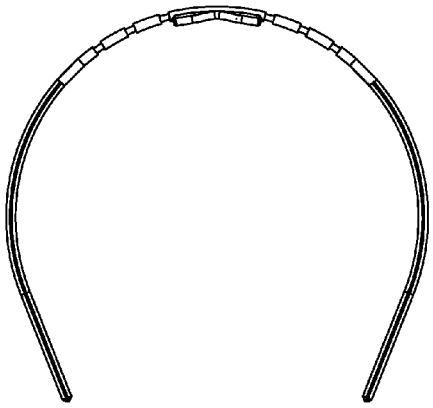
FIG. 31 is a bottom graphic view of the eyeglass frame of FIG. 27.
Figure 32:
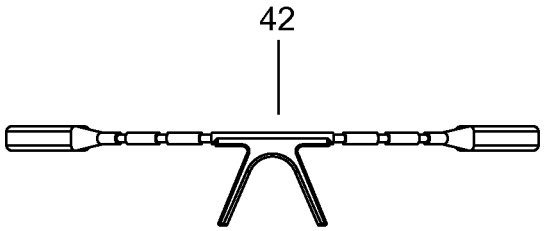
FIG. 32 is an end graphic view of the eyeglass frame of FIG. 27.
Figure 32A:
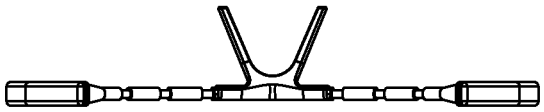
FIG. 32A is an end graphic view of the eyeglass frame of FIG. 27.
Figure 33:
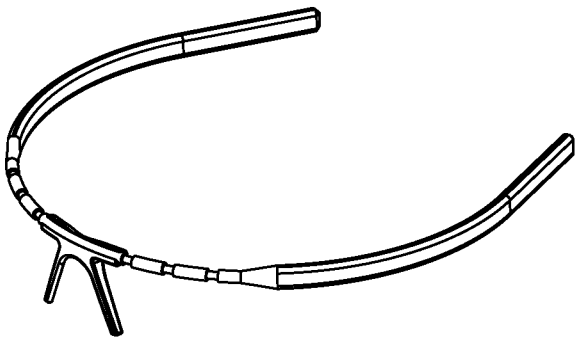
FIG. 33 is an alternate perspective graphic view of the eyeglass frame of FIG. 27.
Figure 34:
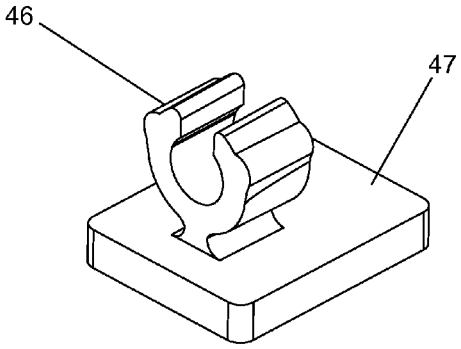
FIG. 34 is a perspective graphic view of a design of a clip according to an exemplary embodiment of the present disclosure.

The headband assembly 10 may include the upper band, cover or element 12 and the lower band, base or element 14. In one exemplary embodiment according to the present disclosure the upper band element 12 and the lower band element 14 are connected to form the overall single hair band assembly 10 that stores the eyewear when not being worn by the user. The upper band element 12 and the lower band element 14 may be connected near the first end portion 16 and near the second end portion 18 on either side. Coupling element 30 is used to connect the upper band element 12 to the lower band element 14. The coupling element 30 may be a rivet, a post with a bushing, a screw, or any other convenient fastening means. In an alternate exemplary embodiment according to the present disclosure, as best shown in FIGS. 10 and 11, the coupling element 30 may include a T-shaped member 30 for being received in a hole 31 located in the side of the lower member 14 as best shown in FIGS. 7 and 26.

In one exemplary embodiment in FIGS. 1 through 3, the coupling element 30 may preferably be generally loose fitting to allow the upper band element 12 and lower band element 14 to frictionally interfere and interlock with each other. The degree of frictional interference may also dictate the type of coupling that may best fit the application of opening, closing and securing the upper band element 12 to the lower band element 14 while in use by a wearer in all types of situations and manner.

FIG. 3 is a cross-sectional view of the headband assembly 10 and viewed along line 3-3 of FIG. 2. The upper band element 12 is provided with a small dimple or raised portion 32 along a peripheral portion of the lower surface 33 that is continuous from the first end portion 16 to the second end portion 18 of the headband assembly 10. The dimple 32 is provided along the front edge 34 as well as along the rear edge 36 of the upper band element 12. The flanges 28 of the lower band element 14 are provided with a comparable recessed dimple or indentation portion 38 to receive the dimple 32 on the lower surface 33 of the upper band element 12. This arrangement allows the storage compartment 40 to be sealed from ambient environmental elements when the upper band element 12 is pivoted towards the lower band element 14 and securely becomes attached to the lower band element 14 as the dimples on the upper band element 12 find the indentations in the flanges 28 of the lower band element 14 and reside therein. The seal is frictional so it may easily be released by simply pushing the upper band element 12 in either a forward or rearward direction and overcoming the frictional seal to provide access to the storage compartment 40.

As earlier disclosed, the size of the storage compartment 40 may be varied by simply providing a lower band element 14 with higher or taller flanges 28, or alternatively a wider, lower band element 14. It is understood that in the case of a larger lower band 14 with taller flanges 28, the upper band element 12 may also be lengthened since the circumferential distance has increased due to the higher flanges 28 on the lower band element 14. However, the devices for coupling or attaching the upper band element 12 to the lower band element 14 or the method of closure of the upper band element 12 to receive the lower band element 14 may remain the same or may be varied. If eyewear is to be stored in the storage compartment 40 it may be stored with the eyeglasses and frame 42 folded as illustrated in FIG. 2 or, where applicable, the arms of the eyeglasses frame 42 may remain open or extended and stored as best shown in FIG. 1 in phantom lines and in FIGS. 4 through 6.

The headband 10 is unique in its combination of providing a storage compartment 40, having particular functionality for receiving glasses 42, and also integrating the use of a hair accessory 44 with the headgear 10. In one exemplary embodiment, the hair accessory 44 may be an artificial or natural hair extension that may be secured to the headband 10 and is adapted to be sandwiched between layers of natural or artificial hair on the wearer's head as best shown in FIG. 1. This combination of features enables a user to add volume to the natural hair on the wearer's head and to dispose the hair accessory 44 in a preferred position so that additional length, additional volume, highlights or the like may be obtained. Other types and kinds of hair accessory 44 may include, but not be limited to artificial or natural hair which may be attached to the headband 10 and adapted to be sandwiched between layers of natural or artificial hair on the wearer's head.

Figure 35:
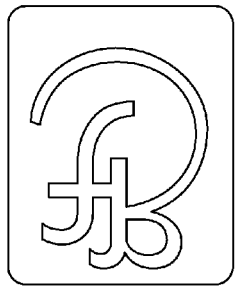
FIG. 35 is an end graphic view of the clip of FIG. 34.
Figure 36:
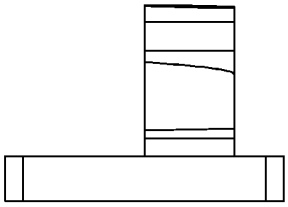
FIG. 36 is a side graphic view of the clip of FIG. 34.
Figure 37:
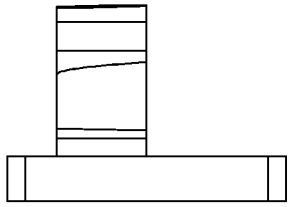
FIG. 37 is an alternate side graphic view of the clip of FIG. 34.
Figure 38:
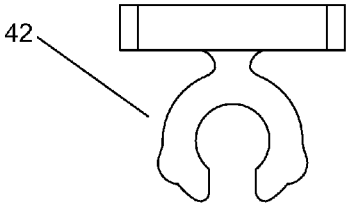
FIG. 38 is an alternate end graphic view of the clip of FIG. 34.
Figure 39:
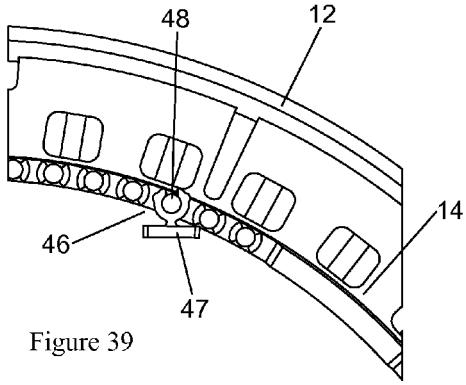
FIG. 39 is a partial side graphic view of a headband including the clip installed thereon according to an exemplary embodiment of the present disclosure.
Figure 40:
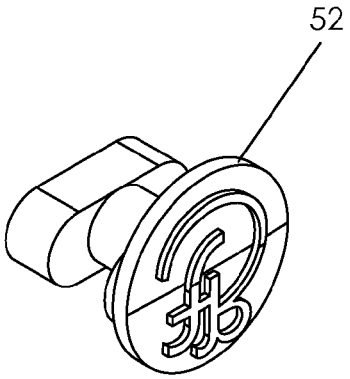
FIG. 40 is a perspective graphic view of a clip according to an alternate exemplary embodiment of present disclosure.
Figure 41:
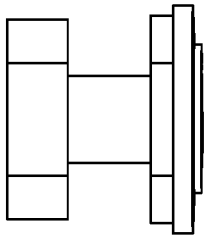
FIG. 41 is a side graphic view of the clip of FIG. 40.
Figure 42:
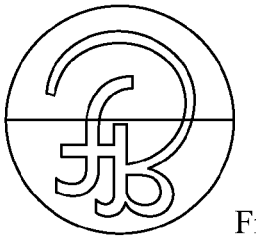
FIG. 42 is an end graphic view of the clip of FIG. 40.
Figure 43:
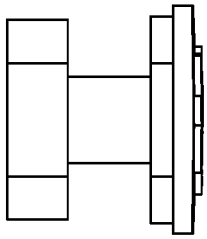
FIG. 43 is an alternate side graphic view of the clip of FIG. 40.
Figure 45:
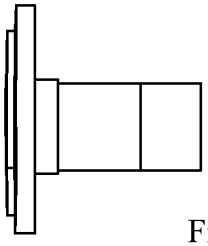
FIG. 45 is an alternate side graphic view of the clip of FIG. 40.
Figure 44:
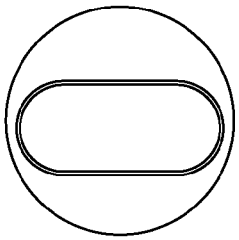
FIG. 44 is an alternate end graphic view of the clip of FIG. 40.
Figure 46:
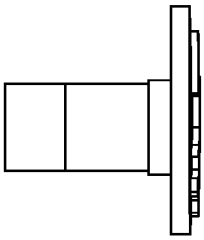
FIG. 46 is an alternate side graphic view of the clip of FIG. 40.

With particular reference to FIG. 3, there is illustrated a hair accessory 44 adapted to be sandwiched between layers of natural or artificial hair on a wearer's head as best shown in FIG. 1. The hair accessory 44 has on one end thereof a first coupling element or clip 46, which may be part of a retaining means, that is adapted to be removably attached to a second coupling element 48, which may also be part of the retaining means, which may be integrated, attached, formed or secured in the lower inside surface 22 of the lower band element 14. It is understood that the retaining means portion mounted on the lower band element may be mounted on any inconspicuous surface such as the flanges 28 or even the lower surface 26. The retaining means may be clips or snaps as shown in FIG. 3 but may also be any one of a variety of retainers or fasteners such as hooks, Velcro, hook and catch strip, quick connect fasteners and the like. In an alternate exemplary embodiment according to the present disclosure, the clip 46 may include a base 47 including an ornamental design as best shown in FIG. 35. In another alternate exemplary embodiment according to the present disclosure the clip 46 may include the ornamental design as shown in FIGS. 34 through 38. Preferably, the base 47 of the clip 46 may be coupled to the accessories 44 for coupling and accessory 44 to the lower band 14 of the headband 10 as shown in FIGS. 3 and 39.

In an exemplary embodiment according to the present disclosure, to retain the hair accessory 44 on the headband 10 it may also be possible to provide the second element as a lateral slot on the lower band element 14 and use the base 47 of the clip or fastening element 46 to attach to the hair accessory and thereafter slide the T-form into the lateral groove made in the lower band element. The hair accessory 44 may be permanently or temporarily attached to the fastening element 46 as by gluing, sewing, or any other convenient attaching method as the user chooses. The first element 46 is thereafter attached to the fastening element 24 and depending on the user's preference, may be placed on the frontal portion of the head as shown in FIG. 1 beneath, on top of or between the portions of the natural hair. Alternatively, the hair accessory 44 may be placed on the sides or back of the wearer's head and brushed backward or sideways to allow portions of the hair accessory 44 to overlie the wearer's own natural or artificial hair as shown in FIG. 1. The lower band element may also be used to retain a hair adornment such as jewelry which after attachment may be placed between or on top of the natural or artificial hair on the wearer's head.

The hair accessory 44 may be used in any preferred manner since there is a plurality of coupling posts or elements located on the lower inside surface 22 of the lower band element 14. For example, where the user's natural hair is thin or there is a bald spot, a suitable amount of hair and several individual hair accessory 44 elements may be massed together and over the thin or bald spot so it may be better covered. Further, the wearer may desire a lesser or greater amount of volume of hair on the hair accessory 44 and this would be made available as desired on the individual hair accessory pieces 44. The hair the hair accessory 44 may be adjustably moved to whatever location dictated by the artistry of the user or wearer.

The hair accessory 44 of the present disclosure may be, due to its secure anchorage by the coupling described, dressed, brushed and washed in the same manner and with or without removal of same but together with dressing and brushing of the wearer's natural hair. The headband 10 may be worn when swimming or slept in as well while still providing a safe, convenient and readily accessible location for the user's eyeglass frame 42.

In one exemplary embodiment, the hair accessory 44 may include, but not be limited to, hair extensions, hair wefts, hair wigs, hair falls, hair mini wigs, hair ponytails, hair braids, hair bangs, hair tendrils, hair buns, hair pieces, hair domes, hair bumps, hair curls, hair bands, hair nets, hair combs, beads, feathers, ribbons, bows, lace, crowns, visors, party hats, standard hats, beanies, game day head accessories, holiday and celebration themed accessories (e.g., Christmas, New Year's Eve, etc.). The headband 10 and its sides 28, cover 18 and top 12 may further be adorned with any kind of beads, semi and precious stones, crystals, animal figures, cartoon character figures, animal ears, scarfs, and etc.

Figure 9:
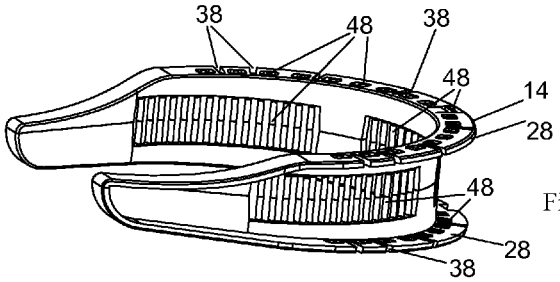
FIG. 9 is a perspective graphic view of the lower portion of the headband of FIG. 7.

Referring now in general to FIGS. 4 through 17, there is disclosed an alternate embodiment of a headband 10 according to an exemplary embodiment of the present disclosure. The headband 10 may still include an upper band or cover 12 and a lower band or base 14. In one exemplary embodiment according to the present disclosure, the lower band 14 may further include a first or front upstanding member 28 and a second or back upstanding member 28. Each upstanding member includes a plurality of notches, cutouts or reliefs 38 for providing flexibility to the lower member 14 so it may be more easily put on and taken off. Each of the upstanding members 28 also further include a plurality of coupling members 48 in the form of a row of bars or rods formed therein and for coupling with the clips of the hair accessory 44. The bottom surface 22 of the lower portion 14 further includes a plurality of coupling members 48 formed therein as well. As best shown in FIGS. 7 and 9, the plurality of coupling members 48 are accessible from either side of the bottom surface 22 and either side of the upstanding members 28 of the lower portion 14 of the headband 10. The back upstanding member 28 may further include a centrally located passage or opening 58.

The upper band or cover portion 12 may include a generally curved, U-shaped design including ends for coupling to the lower band 14. Each end of the upper band 12 may include a T-shaped tab or extension 52 for being rotatably received in a respective hole 62 in the side of the lower band 14. The hole 62 is also keyed or shaped so that the tab 52 may only be inserted or removed from the hole 62 in a given position preferably outside of the normal operating range of the headband 10. It may be appreciated that it is possible to reverse the extension 52 and the hole 62 such that the extension 52 is located on the lower band 14 and the hole 62 is located on the upper band 12 will still providing the opening and closing function of the upper band 12 with respect to the lower band 14. A particularly suitable T-shaped tab or extension member 52 is shown in FIGS. 40 through 46 and includes a unique ornamental design on a base portion for coupling to one of the lower band 14 and the upper band 12.

The upper band 12 may further include a centrally located tab or extension member 13 located at one edge of the upper band 12 and generally extending downward. The extension member 13 may preferably be shaped and located to align with and generally match the hole or opening 58 in the upstanding member 28 of the lower band 14. Since only one upstanding member 28 of the lower band 14 includes the opening 58, the location of the tab 13 of the upper band 12 will provide an opening and closing direction for the upper band 12 on the lower band 14 as the upper band 12 pivots on the lower band 14 about the tabs 52.

Figure 6:
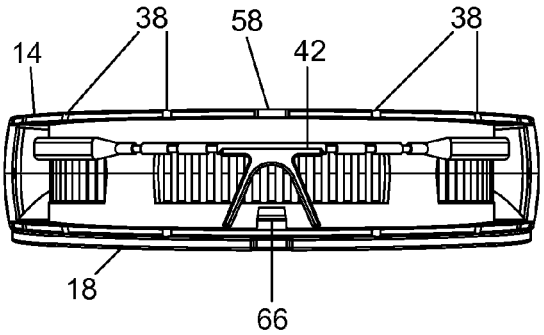
FIG. 6 is a top graphic view of the headband of FIG. 4.
Figure 25:
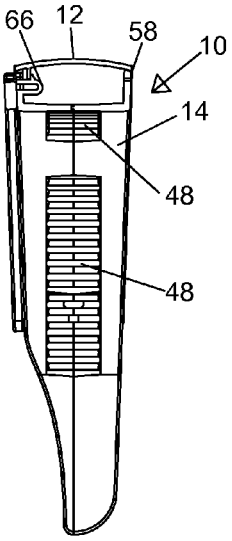
FIG. 25 is a partial section view of the headband of FIG. 18.

The lower band 14 may further include an integral (or even unitary) flexible tab lock member 66 on the other of the upstanding members 28 for locking the upper band member 12 in the closed position as best shown in FIGS. 6 and 25. The tab lock member 66 may include an end accessible from the front of the headband and may be flexed downward to unlock the lock member 66 from the edge 34 of the upper band 12 from the lower band 14 so the upper band 12 may be moved or rotated from the closed position as shown in FIG. 25.

In one alternate exemplary embodiment of the present disclosure, the headband 10 includes a front cover 18 for covering the upstanding flange 28. As best shown in FIGS. 14 through 17, the front cover 18 is a generally U-shaped, planar member and includes a plurality of recesses 19 on one side thereof. The front cover 18 is coupled or connected to the upstanding flange 28 of the base or lower band 14 using a plurality of clips 46. Each clip 46 includes a generally rectangular base portion 49 which is designed to be received in the recess 19 of the front cover 18. The clip 46 may be coupled to the recess 19 in the front cover 18 using any known or appropriate coupling mechanism including an interference fit and/or an adhesive material or any other known or appropriate structure or material. The front cover 18 provides greater flexibility to the design and functionality of the headband 10 so the user may cover the bars 48 to provide a finished look or the cover 18 may be removed to allow the user to couple additional accessories 44 to the bars 48 on the upstanding flange 28 using a plurality of clips 46.

Figure 4:
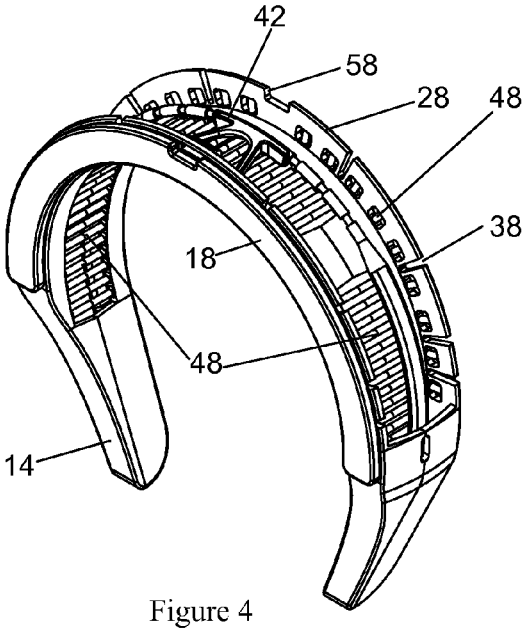
FIG. 4 is a graphic perspective view of a lower portion of a headband according to an alternate exemplary embodiment of the present disclosure including an eyeglass frame stored in the lower portion of the headband.
Figure 5:
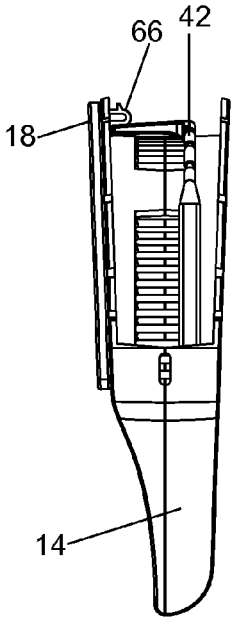
FIG. 5 is a side graphic view of the headband of FIG. 4.

In an alternate exemplary embodiment of the present disclosure as shown in FIGS. 27 through 33 there is disclosed an ornamental design for an eyeglass frame 42. The frame 42 may be located in the storage compartment 40 of the headband 10 as best shown in FIGS. 4 through 6. In particular, the location of the eyeglass frame 42 with in the cavity 40 of the headband 10 is such that the lock tab 66 is centrally located in the nosepiece of the frame 42.

In a further alternate exemplary embodiment of the present disclosure as shown in FIGS. 27 through 33 there is disclosed an ornamental design for an eyeglass frame 42. The frame 42 may be located in the storage compartment 40 of the headband 10 as best shown in FIGS. 4 through 6. In particular, the location of the eyeglass frame 42 with in the cavity 40 of the headband 10 is such that the lock tab 66 is centrally located in the nosepiece of the frame 42.

Figure 47:
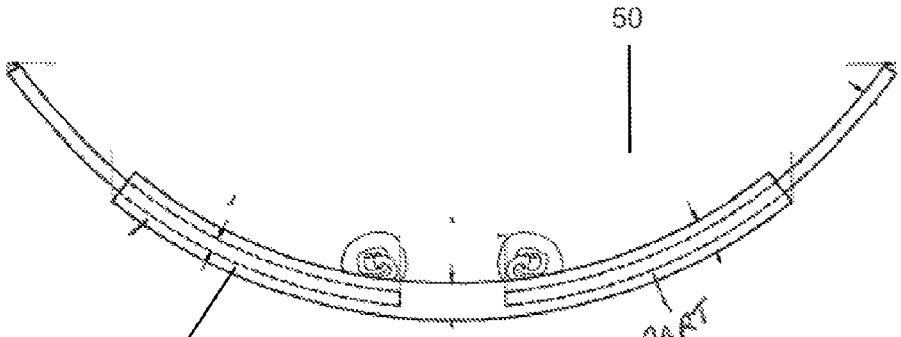
FIG. 47 is a top graphic view of a pair of lenses for coupling to the eyeglass frames according to an exemplary embodiment of the present disclosure.
Figure 48:
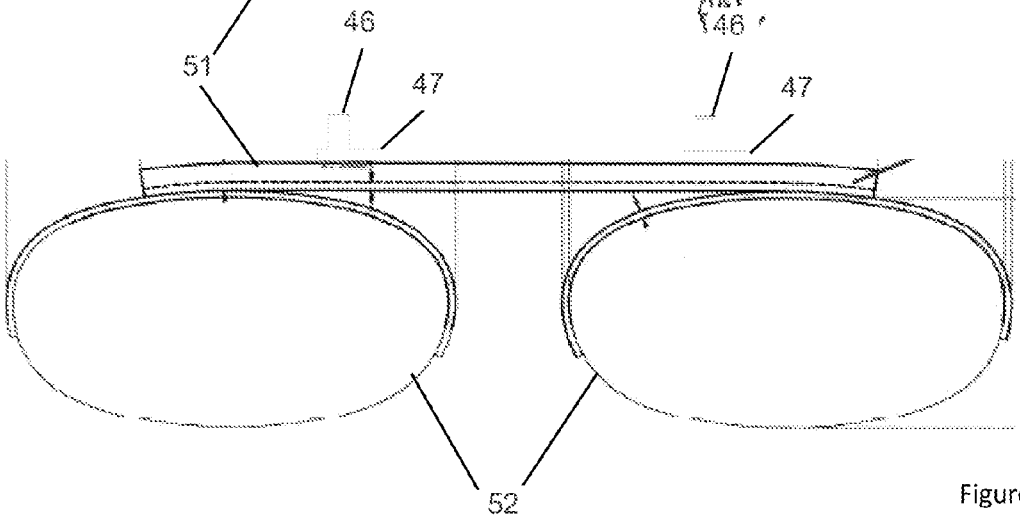
FIG. 48 is a front graphic view of the pair of lenses of FIG. 47.

In a further alternate exemplary embodiment of the present disclosure as shown in FIGS. 18 through 24, there is disclosed an ornamental design for a headband 10. In yet a further alternate exemplary embodiment of the present disclosure is shown in FIGS. 47 and 48, there is disclosed a pair of glasses or lenses 50 including an upper member 51 from which a pair of spectacle lenses 52 depend. The lenses 50 include a pair of clips 46 having their bases 47 coupled to an upper surface of the member 51. The lenses 50 may be coupled to the frame 42 using the clips 46 coupled to the coupling member 48 located on the frame 42. It should be appreciated that the flexible nature of the design of the headband 10 and the frame 42 and lenses 50 provide for a highly customizable combination of components and features. In particular, the use of a standardized clip 46 may allow the accessories 44 to also be coupled to the bar 48 of the frame 42 as well as the coupling members are bars 48 of the lower band 14. Further, the use of the clip 46 with the lenses 50 may allow a user to have different shape lenses 50 that may be clipped and unclipped with the frame 42. Additionally, the combination of the frame 42 the lenses 50 and the headband 10, as well as the accessories 44, provide for a highly usable and customizable headband 10 that provides protection to the lenses 50 and the frame 42 when located in the compartment 40 of the headband 10.

Any numerical values recited herein or in the Figures are intended to include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

It is understood that the present description is intended to be illustrative and not restrictive. Many embodiments as well as many applications besides the examples provided will be apparent to those of skill in the art upon understanding the present disclosure. The scope of the claimed invention should, therefore, not be determined with limiting reference to the description, but should instead be determined with reference to the appended claims, along with the full scope of equivalents to which such claims are entitled. Any disclosure of an article or reference, including patent applications and publications, is incorporated by reference herein for all purposes. Any omission in the following claims of any aspect of subject matter disclosed herein is not a disclaimer of such subject matter.

Unless expressly stated, all ranges are intended to include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The use of the term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

The disclosure of "a" or "one" to describe an element, ingredient, component or step is not intended to foreclose additional elements, ingredients, components or steps. Plural elements, ingredients, components or steps can be provided by a single integrated element, ingredient, component or step. Alternatively, a single integrated element, ingredient, component or step might be divided into separate plural elements, ingredients, components or steps.

What is claimed is:

1. A headband assembly comprising:

a lower band member having opposing first and second distal end portions, the lower band member having a lower inside surface that, in position, faces the wearer's head;

an upper band member having first and second distal end portions, the first and second distal end portions being pivotably attached to the lower band member;

wherein the lower band member having an upstanding flange about its periphery to define a storage compartment within the peripheral upstanding flange, the upstanding flange terminating in an end portion having a plurality of reliefs along the upstanding flange for providing flexibility to the lower band; and wherein the upper band member having an upper top surface and a lower surface, the upper band member further having a front edge, a rear edge and a raised portion peripherally extending from the first end portion to the second end portion of the upper band member spaced adjacent the front edge and the rear edge of the upper band member.

2. The headband assembly of claim 1 wherein each the upper band member and lower band member is generally shaped to conform to a human head when positioned over the top of a wearer's head, the lower band member including a plurality of notches for making the lower band member flexible, and wherein the upper band element and the lower band element define a cavity for securing an article.

3. The headband assembly of claim 1 wherein the first and second distal end portions of each the upper and lower band elements further comprises a pivotable coupling such that the upper band element pivots with respect to the lower band element.

4. The headband assembly of claim 1 wherein the upper band member and the lower band member define a compartment there between and further wherein the lower band member includes a plurality of connectors for attaching the hair accessory to the lower band member.

5. A headband assembly comprising:

an upper band member;

a lower band member juxtaposed the upper band member, the upper band member and lower band member shaped as respective open loops that conform to the shape of the head of a wearer when positioned on the top of a wearer's head, the upper band member and the lower band member extend from a first end portion proximate the wearer's ear, across the head, and continues over the head to a second end portion proximate the wearer's other ear on the opposite side of the head;

the lower band member having an upstanding flange about its entire periphery to define a storage compartment within the peripheral upstanding flange, the upstanding flange terminating in an end portion having a plurality of reliefs along the upstanding flange for providing flexibility to the lower band;

the upper band member having an upper top surface and a lower surface opposite to the upper surface, the upper band member further having a front edge, a rear edge and a raised dimple portion peripherally extending from the first end portion to the second end portion of the upper band member spaced adjacent the front edge and the rear edge of the upper band member;

a clip for coupling the upper band member to the lower band member.

6. A headband assembly comprising:

an upper band member;

a lower band member juxtaposed the upper band member, the upper band member and lower band member shaped as respective open loops that conform to the shape of the head of a wearer when positioned on the top of a wearer's head, the upper band member and the lower band member extend from a first end portion proximate the wearer's ear, across the head, and continues over the head to a second end portion proximate the wearer's other ear on the opposite side of the head;

the lower band member having an upstanding flange about its entire periphery to define a storage compartment within the peripheral upstanding flange, the upstanding flange terminating in an end portion having a plurality of reliefs along the upstanding flange for providing flexibility to the lower band; and the upper band member having an upper top surface and a lower surface opposite to the upper surface, the upper band member further having a front edge, a rear edge and a raised dimple portion peripherally extending from the first end portion to the second end portion of the upper band member spaced adjacent the front edge and the rear edge of the upper band member.

7. The headband assembly of claim 6 wherein the lower band member includes a plurality of connectors for attaching a hair accessory to the lower band member.

* * * * *